US005887769A

United States Patent [19]

Kidd

[11] Patent Number: 5,887,769

[45] Date of Patent: Mar. 30, 1999

[54] DISINFECTANT DISPENSING APPARATUS

[76] Inventor: Terrel G. Kidd, 14 S. 655 West, Blackfoot, Id. 83221

[21] Appl. No.: 856,366

[22] Filed: May 14, 1997

[51] Int. Cl.[6] ..... B05B 7/00

[52] U.S. Cl. ..... 222/630; 222/145.5; 4/222; 4/628

[58] Field of Search ..... 222/1, 146.5, 145.5, 222/630, 148; 4/675, 676, 677, 661, 222, 628, 638; 422/256, 260

[56] References Cited

U.S. PATENT DOCUMENTS

| | | | |
|---|---|---|---|
| 1,715,933 | 6/1929 | Lewis et al. | 4/628 X |
| 2,129,944 | 9/1938 | Ladewig | 4/222 |
| 2,181,069 | 11/1939 | Robinson | 210/28 |
| 3,934,822 | 1/1976 | Rose | 239/226 |
| 3,961,984 | 6/1976 | Torressen | 134/100 |
| 4,200,206 | 4/1980 | Chase et al. | 222/148 X |
| 5,625,908 | 5/1997 | Shaw | 4/628 X |

*Primary Examiner*—Gregory L. Huson
*Attorney, Agent, or Firm*—Hopkins Roden Crockett Hansen & Hoopes

[57] ABSTRACT

A sink disinfecting apparatus consisting of a dual compartment container having a water reservoir in one half and a disinfectant reservoir in the other half. The heated water reservoir is connected to the house cold water supply and discharges to a venturi which aspirates disinfectant from the disinfectant reservoir which then discharges through a valve to a disinfectant tray holding a sponge or other type of cleaning pad. A mixture of water and disinfectant is discharged to the tray by operating a push button valve.

16 Claims, 3 Drawing Sheets

DISINFECTANT DISPENSING APPARATUS

TECHNICAL FIELD

This invention relates to a kitchen sink sponge disinfectant apparatus that is activated by depressing a push-button valve causing disinfectant and water to be dispensed on a sponge within a sponge container.

BACKGROUND OF THE INVENTION

In order to reduce the possibility of food contamination and food poisoning, it is necessary to frequently clean and disinfect kitchen counters, sinks, food utensils and food handling equipment. Cleaning pads and sponges often contribute to the spread of food contaminants. If the cleaning pad or sponge is not carefully rinsed and disinfected, it may spread the offending microorganisms or bacteria from a contaminated surface to a previously noncontaminated surface. Food coming in contact with the contaminated surface then becomes contaminated. It is the purpose of this invention to provide an easily actuated sponge disinfectant dispensing apparatus for flooding a sponge in a tray with a mix of disinfectant and water when a valve is opened.

SUMMARY OF THE INVENTION

The dispensing apparatus of the present invention consists of a tray built into or added onto a sink. The dispensing apparatus includes a valve that, when opened, dispenses a mixture of water and disinfectant onto a sponge or cleaning pad. Drain holes in the tray allow the excess mixture of water and disinfectant to drain into the sink.

Water is supplied from a pressurized water source through a water inlet line and preferably through an inlet check valve to the water reservoir. When the dispensing valve is opened, water from the water source is forced into the water reservoir. Water is then forced from the water reservoir through a venturi. As the water passes through the venturi, disinfectant is aspirated from the disinfectant reservoir into the venturi. The disinfectant mixes with the water and the mixture is forced out of the venturi and through a supply line to the dispensing valve. The disinfectant and water are stored in individual reservoirs, preferably in a dual compartment container under the sink. Appropriate check valves prevent undesirable mixing of water and disinfectant.

Other objects, advantages, and capabilities of the present invention will become more apparent as the description proceeds.

DETAILED DESCRIPTION OF THE INVENTION

Figure 1:
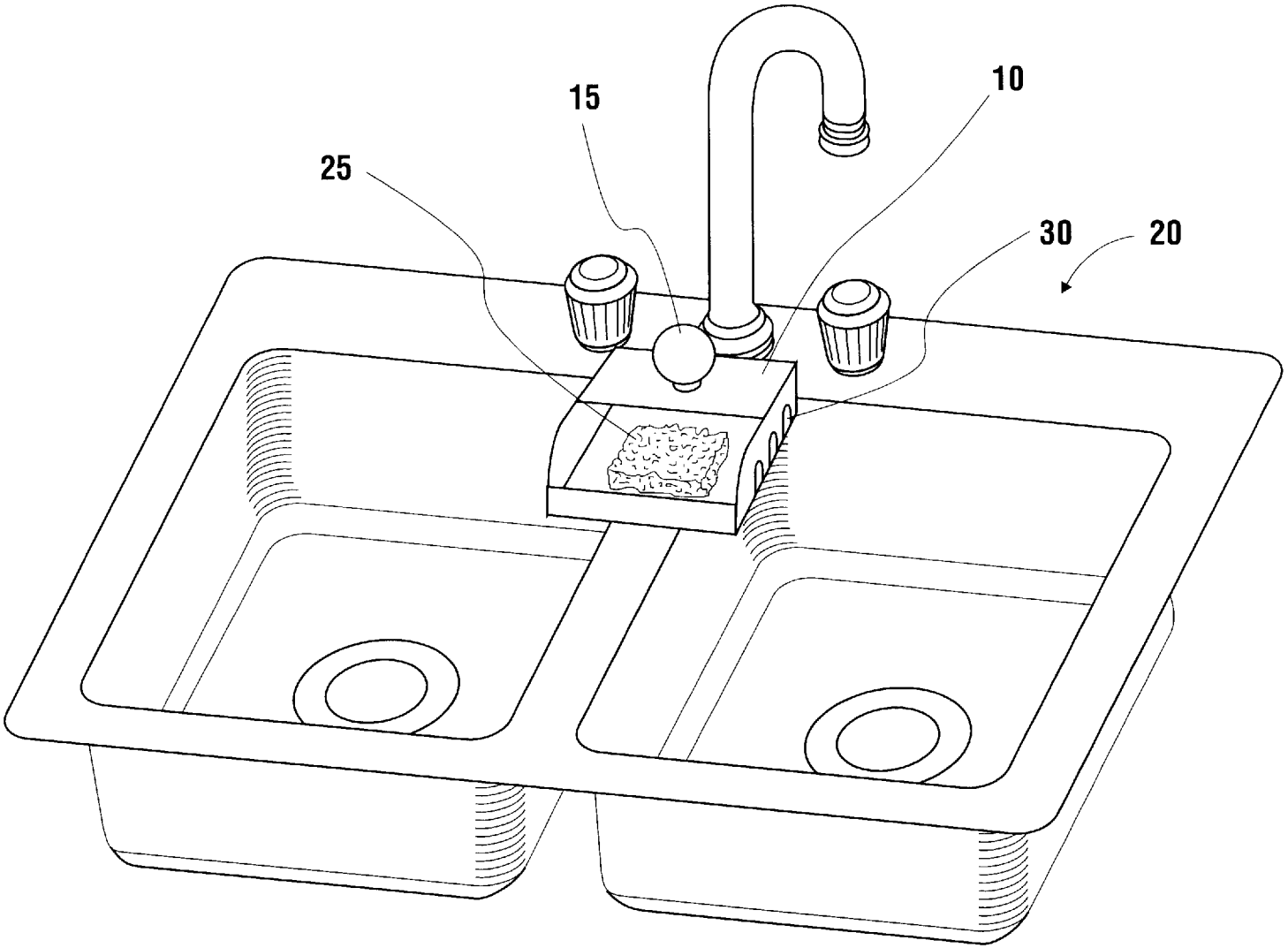
FIG. 1 is a perspective view of an integral built-in sponge tray of the present invention.

The invention will be described by referring to FIGS. 1 and 2. FIG. 1 illustrates an integral built-in disinfectant dispensing tray 10 having a dispensing tray valve 15 mounted on sink 20. Dispensing tray valve 15 is preferably a spring return push button valve. Dispensing tray 10 contains a typical sponge or other type of cleaning pad 25.

Drain apertures 30 are formed in the bottom of tray 10 to allow excess liquid to drain. Opening dispensing tray valve 15 will spray a water and disinfectant mixture onto the sponge until dispensing tray valve 15 is closed.

Figure 2:
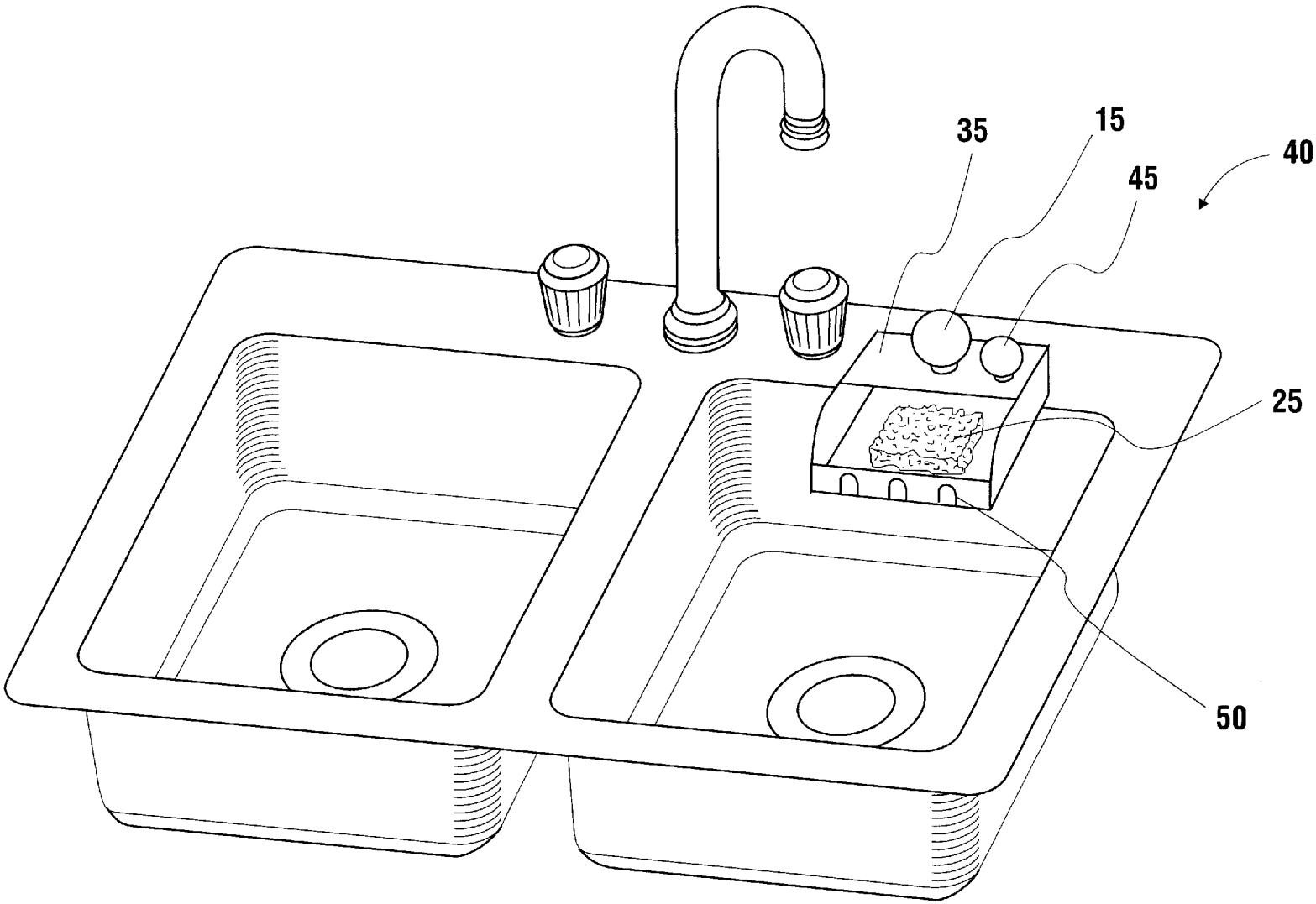
FIG. 2 is a perspective view of an add-on sponge tray.

FIG. 2 illustrates an add-on dispensing tray 35 attached to sink 40. Dispensing tray 35 is attached by fastener 45 to sink 40. In this configuration, drain apertures 50 are preferably located in the forward portion of tray 35.

Figure 3:
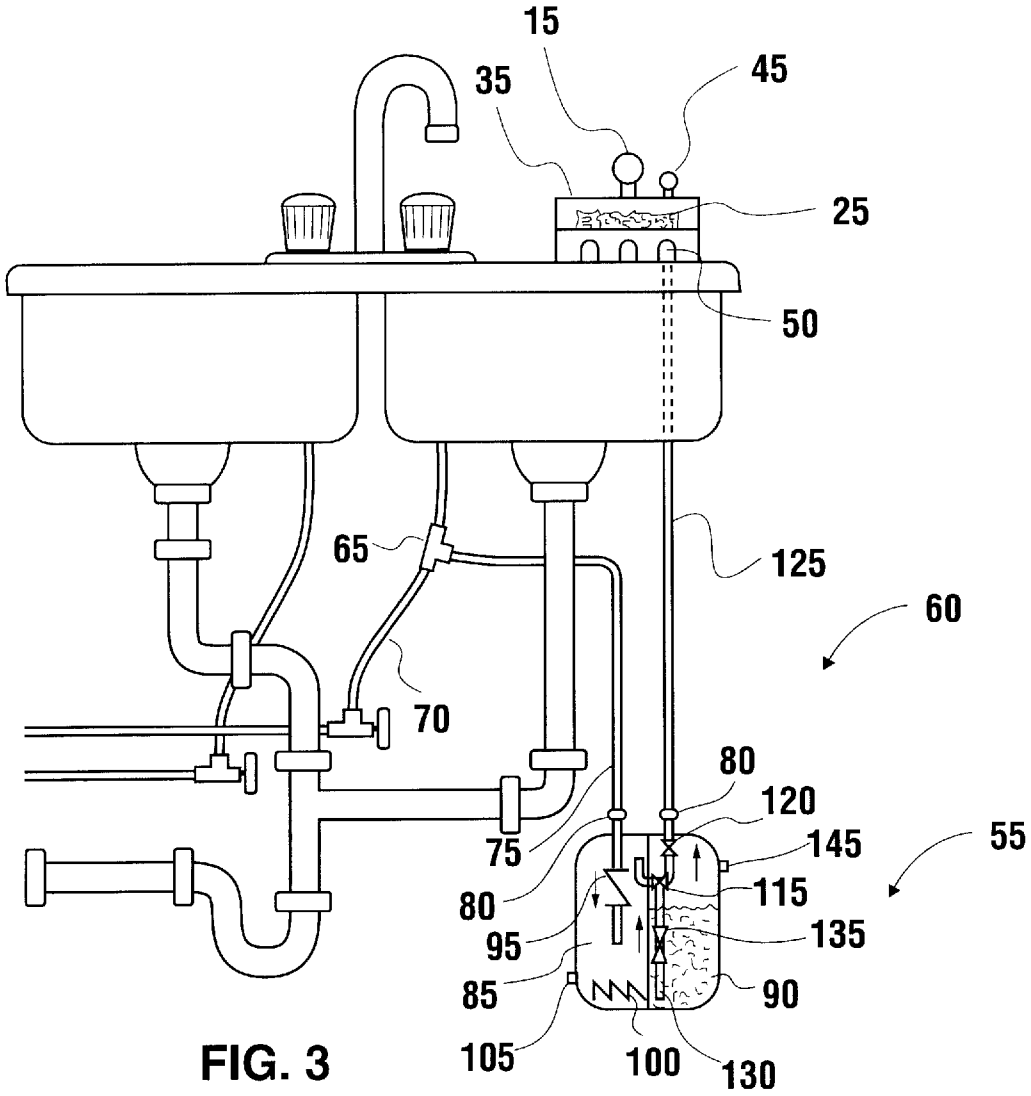
FIG. 3 is a front elevation of the tray and plumbing system.

FIG. 3 illustrates add-on dispensing tray 35, a dual compartment water and disinfectant container 55, and an associated plumbing system 60. To install this plumbing system 60, a piping tee 65 is installed in cold water supply pipe 70 and an inlet pipe 75 is connected by coupling 80 to the container 55. Container 55 and piping assembly can be installed in a cabinet under the sink or some other cabinet in the kitchen and can be easily removed by disconnecting at coupling 80 for maintenance and cleaning.

Within container 55 are two compartments. These compartments are a water reservoir 85 and a disinfectant reservoir 90. Alternatively, water reservoir 85 and disinfectant reservoir 90 are each in separate single compartment containers. Preferably, inlet check valve 95 prevents water or disinfectant from flowing into cold water pipe 70.

A heater 100 and thermostat 105 maintain water reservoir 85 at a nominal room temperature of about 70° F. The electric heater 100 is preferably a 120 volt low wattage and can be inserted in a heater well or clamped on the outside of water reservoir 160. The adjustable thermostat 105 could be set at any temperature comfortable to the hands, i.e. 70°–120° F.

A venturi inlet pipe 110 provides fluid comnunication between water reservoir 85 and a venturi 115 within the disinfectant reservoir 90. Venturi 115 preferably discharges through a discharge check valve 120 to coupling 80 and tray supply pipe 125. Check valve 120 prevents water and disinfectant from flowing into disinfectant reservoir 90 and water reservoir 85.

A venturi aspirator pipe 130 preferably also has a check valve 135 to prevent water and disinfectant from flowing into disinfectant reservoir 90 when dispensing tray valve 15 is closed and the disinfectant reservoir 90 is not completely full.

Figure 4:
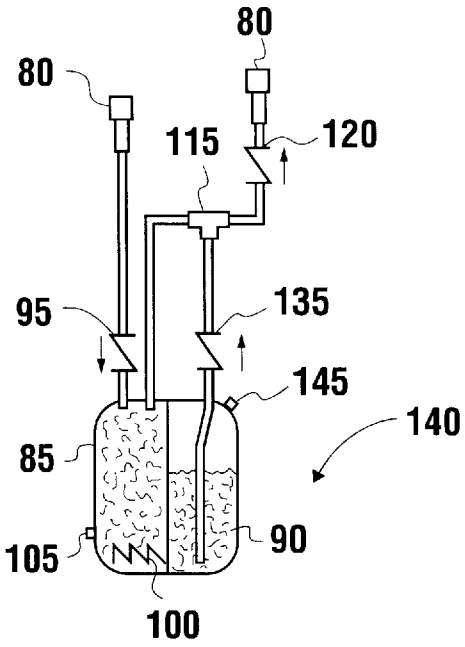
FIG. 4 is a front elevation of an alternate embodiment plumbing system.

FIG. 3 indicates check valves 95, 120, and 135 and venturi 115 are within container 55. An alternate embodiment is illustrated in FIG. 4 where check valves 95, 120, and 135 and venturi 115 are external to a container 140. In either case, whether the piping and valves are internal or external to container 55 or 140, when valve 15 is depressed (opened) water flows into the water reservoir, through venturi 115, aspirating the disinfectant into venturi 115 and discharging the mixture through discharge check valve 120 up to tray 35. Typical capacities for the water reservoir 85 and disinfectant reservoir 90 are about two quarts for each. The disinfectant can be installed through a fill connection 145. An advantage of providing plumbing internal to container 55 is that it is self-contained and compact. An advantage of providing the check valves 90, 120, 135 and venturi 115 external to container 140 is that the check valves and venturi can be maintained and serviced easily.

While the present invention has been described by reference to specific embodiments, it will be apparent that other alternative embodiments and methods of implementation or modification may be employed without departing from the true spirit and scope of the invention.

What is claimed is:

1. A disinfectant dispensing apparatus for dispensing disinfectant mixed with water from a pressurized water source to a cleaning pad, the disinfectant dispensing apparatus comprising:

(a) a water reservoir in fluid communication with the pressurized water source;

(b) a disinfectant reservoir;

(c) a venturi having an inlet, an aspirator, and an outlet;

(d) said inlet of said venturi in fluid communication with said water reservoir;

(e) said aspirator of said venturi in one way fluid communication with said disinfectant reservoir wherein fluid flows in the direction from said disinfectant reservoir to said venturi;

(f) a dispensing tray for holding the cleaning pad, said dispensing tray having holes formed therein for draining liquid from said dispensing tray; and, (g) a dispensing tray valve in fluid communication with said outlet of said venturi, said dispensing tray valve positioned so that fluid flowing out of said dispensing tray valve is dispensed onto the cleaning pad in said dispensing tray.

2. The apparatus of claim 1 wherein said water reservoir and said disinfectant reservoir are each one compartment of a dual compartment container.

3. The apparatus of claim 1 wherein said water reservoir further includes a heater for maintaining water in said water reservoir at a temperature above room temperature.

4. The apparatus of claim 1 wherein the dispenser tray is integral to a sink.

5. The apparatus of claim 1 wherein the dispenser tray is fixedly attached to a sink.

6. The apparatus of claim 1 wherein the dispenser tray valve is a spring return push button valve.

7. The apparatus of claim 1 further including a check valve in a fluid path of said outlet of said venturi between said venturi and said dispenser tray valve, and wherein said check valve prevents liquid from flowing in the direction from said dispensing tray valve to said venturi.

8. The apparatus of claim 1 further including a check valve between said water reservoir and the water source, and wherein said check valve prevents liquid from flowing in the direction from said water reservoir to the water source.

9. The apparatus of claim 1 further including wherein a check valve in a fluid path of said aspirator of said venturi between said venturi and said disinfectant reservoir, and wherein said check valve prevents liquid from flowing in the direction from said venturi to said disinfectant reservoir.

10. A disinfectant dispensing apparatus for dispensing disinfectant mixed with water from a pressurized water source to a cleaning pad, the disinfectant dispensing apparatus comprising:

(a) a dual compartment container having a water reservoir and a disinfectant reservoir;

(b) a first check valve interconnecting said water reservoir and the pressurized water source, said first check valve providing one way fluid communication from the pressurized water source to said water reservoir;

(c) a venturi having an inlet, an aspirator, and an outlet;

(d) said inlet of said venturi in fluid communication with said water reservoir;

(e) a second check valve interconnecting said aspirator of said venturi and said disinfectant reservoir, said second check valve providing one way fluid communication from said disinfectant reservoir to said aspirator of said venturi;

(f) a dispensing tray for holding the cleaning pad, said dispensing tray having holes formed therein for draining liquid from said dispensing tray;

(g) a dispensing tray valve in fluid communication with said outlet of said venturi, said dispensing tray valve positioned so that fluid out of said dispensing tray valve is dispensed onto the cleaning pad in said dispensing tray; and, (h) a third check valve interconnecting said outlet of said venturi and said dispenser tray valve, said third check valve providing one way fluid communication from said outlet of said venturi to said dispensing tray valve.

11. The apparatus of claim 10 wherein said first, second, and third check valves and said venturi are within said dual compartment container.

12. The apparatus of claim 10 wherein said first, second, and third check valves and said venturi are external to said dual compartment container.

13. The apparatus of claim 10 wherein said water reservoir further includes a heater for maintaining water in said water reservoir at a temperature above room temperature.

14. The apparatus of claim 10 wherein the dispenser tray is integral to a sink.

15. The apparatus of claim 10 wherein the dispenser tray is fixedly attached to a sink.

16. The apparatus of claim 10 wherein the dispenser tray valve is a spring return push button valve.

* * * * *